US006808385B2

(12) United States Patent
Garloch et al.

(10) Patent No.: US 6,808,385 B2
(45) Date of Patent: Oct. 26, 2004

(54) FURNACE SOUND SHIELD

(75) Inventors: Duane D. Garloch, Carmel, IN (US); Timothy J. Waterman, Carmel, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/361,224

(22) Filed: Feb. 10, 2003

(65) Prior Publication Data

US 2004/0157179 A1 Aug. 12, 2004

(51) Int. Cl.[7] ..... F23D 5/12
(52) U.S. Cl. ..... 431/114; 126/112
(58) Field of Search ..... 431/114; 126/112, 126/99 D

(56) References Cited

U.S. PATENT DOCUMENTS 6,126,436 A * 10/2000 Cabrera et al. ..... 431/114
6,474,329 B1 * 11/2002 Sears et al. ..... 126/110 A
6,491,514 B1 * 12/2002 Hamad et al. ..... 431/114

* cited by examiner

*Primary Examiner*—Alfred Basichas

(57) ABSTRACT

A sound shield is positioned between the burner chamber of a furnace and the portion of the furnace immediately in front of the burner chamber which is typically a removable door. The removable door has slotted vents that allow air to be drawn into the burner chamber. The sound shield is positioned between the slotted vents and the burner chamber in such a manner so as to prevent substantial amounts of burner noise being produced by burning fuel from escaping through the vents. This is done without unduly restricting the flow of air through the slotted vents to the burner chamber.

15 Claims, 5 Drawing Sheets

FURNACE SOUND SHIELD

BACKGROUND OF THE INVENTION

This invention relates to furnaces having one or more burners which provide heat to one or more heat exchangers. In particular, this invention relates to a method and apparatus for shielding a person in the immediate vicinity of the furnace from the sound produced by the one or more burners.

The burners of modern day furnaces provide significant amounts of heat to one or more heat exchangers within the furnace. In order to do so, the burners must draw in significant amounts of air into the burner chamber. The drawn in air mixes with fuel that is introduced into the burners and ignited. The result is a high quality flame that often also produces a significant amount of noise.

The air is typically drawn through slotted vents in a removable door for the furnace that is positioned in front of the burner chamber. It has heretofore not been deemed appropriate to place any significant obstruction between the slotted vents in the door and the burner chamber. This has however sometimes led to a high level of noise being emitted through the slotted vents due to the intense burning of the fuel by the burners. Such noise levels can be disconcerting to anyone in the immediate vicinity of the furnace. It would be preferable if a person in the vicinity of the furnace could be shielded from these noise levels.

SUMMARY OF THE INVENTION

The present invention provides a furnace with a sound shield positioned between burners located within a burner chamber of a furnace and the portion of the furnace immediately in front of the burner chamber. This latter portion of the furnace is typically a removable door having slotted vents that allow air to be drawn into the burner chamber. The sound shield is positioned between the slotted vents and the burner chamber in such a manner so as to prevent substantial amounts of burner noise being produced by burning fuel from escaping through the vents. This is done without unduly restricting the flow of air through the slotted vents to the burners.

In a preferred embodiment, the sound shield is attached to the rear of the removable door at a distance from the slotted vents in the door. The sound shield preferably extends both above and below the burners so as to directly interfere with the sound wave propagations from the burners when fuel is being burned. In another embodiment, this sound shield extends into the furnace so as to be closer to the burners.

In yet another embodiment, the sound shield is attached to the body of the furnace instead of the removable door. The sound shield preferably extends both above and below the burners so as to provide a direct interference barrier to the sound wave propagations from the burners when fuel is being burned. This sound shield may either be flat against the body of the furnace or alternatively may extend into the interior of the furnace or into the interior of the removable door.

In yet still another embodiment, the sound shield may be attached to the burner chamber structure as opposed to the body of the furnace. In this latter case, the widthwise dimension of the sound shield need not span the entire width of the furnace body.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
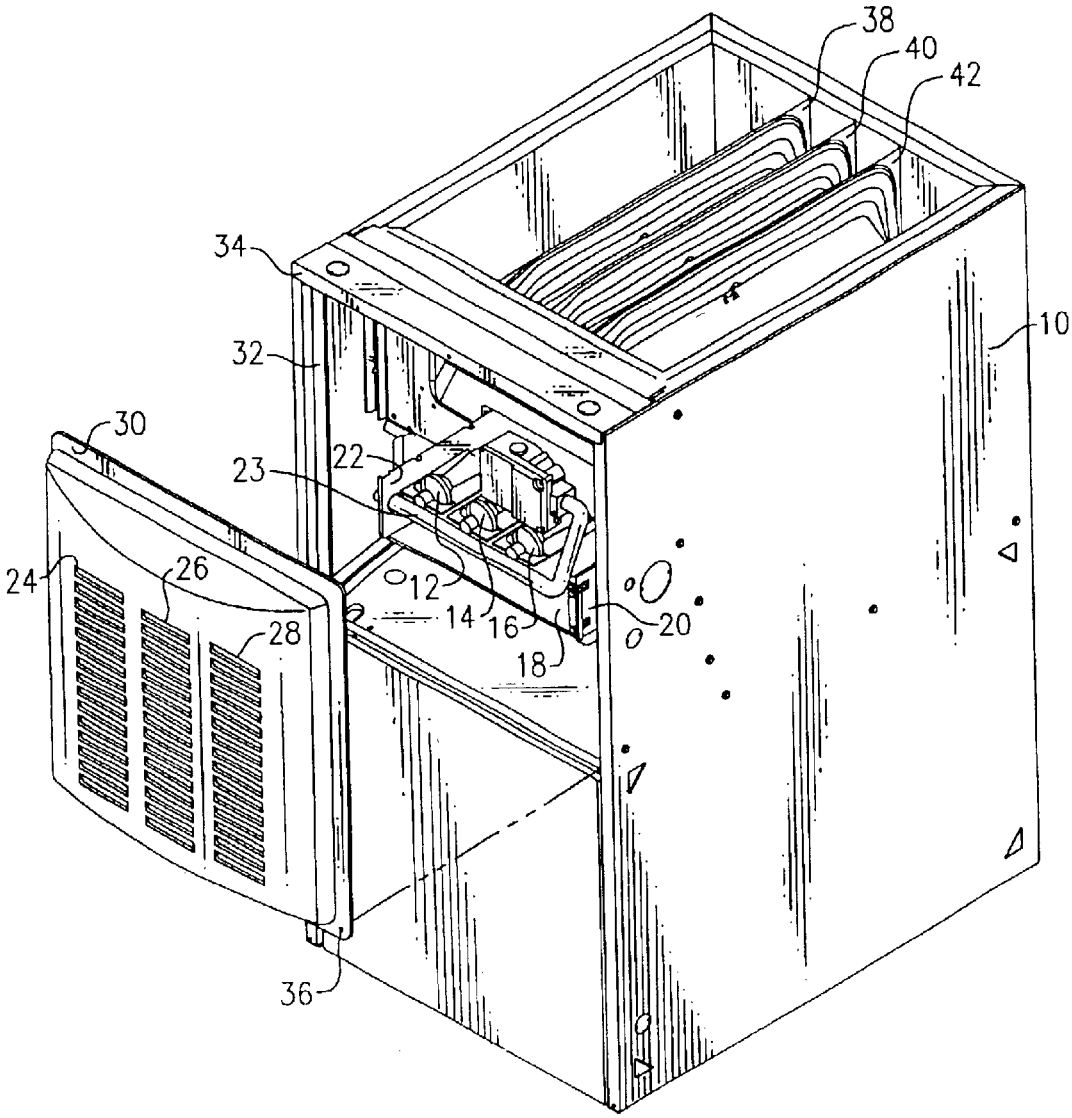
FIG. 1 is a perspective view of a furnace having a removable door that is moved into place in front of a burner assembly in the furnace.

Referring to FIG. 1, a furnace 10 is seen to include an assembly of burners 12, 14, and 16 within a burner chamber 18 defined in part by chamber side members 20 and 22. The burners receive fuel under pressure from ports in a manifold 23. Air is also drawn into each burner so as to mix with the steady flow of fuel. This mixture of air and fuel is ignited so as to produce flames at the opposite ends of the burners. Air is normally drawn into the burner chamber 18 through slotted vents such as 24, 26, and 28 in a removable cover piece 30. The removable cover piece 30 normally covers the burner chamber 18 and various other interior components of the furnace. This removable cover piece will hereinafter be referred to as door 30. The door 30 is preferably tilted and slid into place along slightly recessed vertical members such as 32 within the furnace body. The top edge of the door is captured under a downwardly extending member 34 of the furnace when the door has been completely slid into place. The door 30 is then preferably secured by a pair of fasteners inserted through holes such as 36 shown in the bottom most part of the door 30. It is to be understood that the door 30 could be attached to the body of the furnace in any number of ways other than as shown in FIG. 1. For example, the door could have shaped edges that engage appropriately shaped guides in the furnace so as to not require fasteners. Alternatively, the removable door could simply be secured to either the recessed vertical members such as 32 or simply to the front of the furnace by fasteners.

The flame produced by the ignited mixture of air and fuel of a burner provides heat to a corresponding one of the heat exchangers 38, 40, or 42. It is to be appreciated that the arrangement of the burners and corresponding heat exchangers could be quite different. For example, the number of burners and heat exchangers could be more or less than what is shown. Furthermore, the shape and configuration of the burners and heat exchangers could be quite different.

Figure 2:
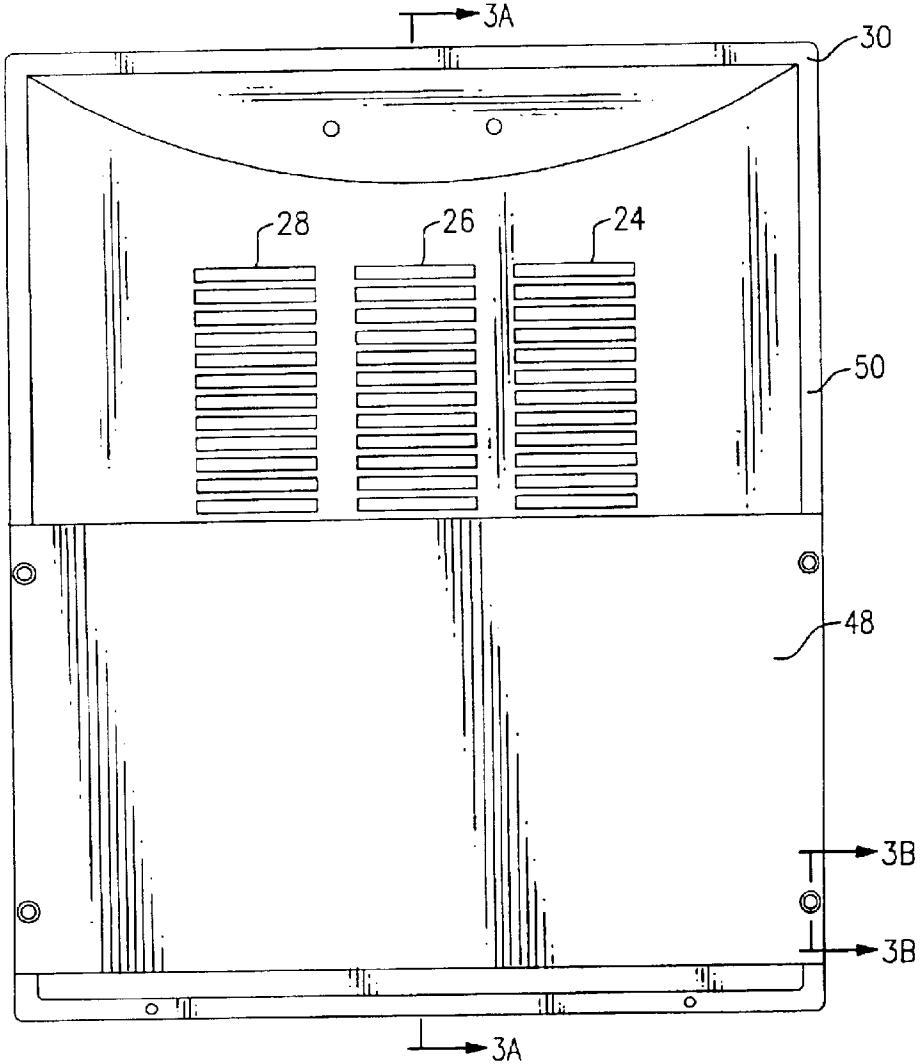
FIG. 2 is a rear view of the removable door of FIG. 1 illustrating an attached sound shield.

Referring to FIG. 2, a sound shield 48 is fixedly attached to inwardly turned back edges such as 50 of the door 30. The height of the sound shield 48 is preferably set so as to present a barrier that interferes with the noise waves emanating from or being propagated by the flames produced by the burners 12, 14, and 16. In so doing, these noise waves are prevented from merely exiting the slotted vents in the door 30 behind the sound shield in FIG. 2. These noise waves are instead reflected back toward the burner chamber 18. It is to be noted that the height of the sound shield does not encompass all of the slotted vents in the door 30. Preferably no more than fifty percent of the slotted vents are covered by the sound shield although this may vary depending on the size of the vents that are not covered and the particular air flow needed by the burners.

Figure 3A:
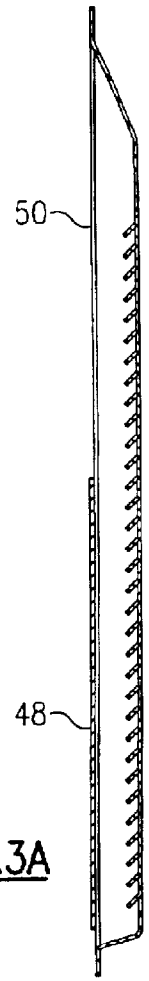
FIGS. 3A and 3B are further detailed views of the removable door and attached sound shield of FIG. 2.
Figure 3B:
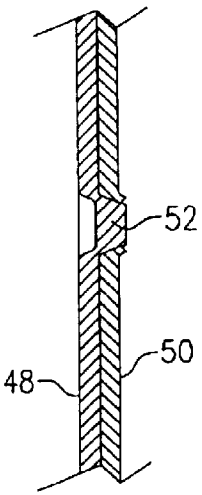

Referring now to FIG. 3A, the thickness of the shield 48 is relatively thin so as to minimize the added thickness to the inwardly turned door edges such as 50 which must fit against the vertical members 32 of the furnace. The sound shield is preferably fixedly attached to the inwardly turned door edges by Tox or Tog-L-Loc sheet metal fastening methods so as to result in a forcible depression 52 of the shield through the door edge 50 as shown in FIG. 3B. It is to be appreciated that other sheet metal fastening methods may be used, including for instance various sheet metal fasteners such as rivets or treaded fasteners. The sound shield is preferably fabricated from sheet metal having a thickness preferably in the range of three hundredths to five hundredths of an inch. It is however to be appreciated that this preferred thickness range can be further varied depending on the particular fit needed against the vertical members 32 of the furnace. As previously noted, the height of the sound shield will vary depending on the amount of vertical height needed to deflect or create a barrier to the sound waves propagated by the burner flames. In the preferred embodiment, this height is chosen such that the sound shield preferably extends from slightly below the burner chamber to slightly above the burner chamber. The sound shield must also be spaced from the slotted vents in the door 30 so as to allow the air flow through the vents in front of the shield to flow up and over the sound shield. For the curved door 30 of FIG. 1, this is preferably two tenths of an inch as measured from either turned in back edge of the door to the back side of the front of the door with the spacing increasing toward the center of the door. It is however to be appreciated that the amount of spacing of the sound shield from the back side of the door will vary depending on the amount of the door with slotted vents that is not to be obstructed by the sound shield as well as the particular air flow demand called for by the burners.

Figure 4A:
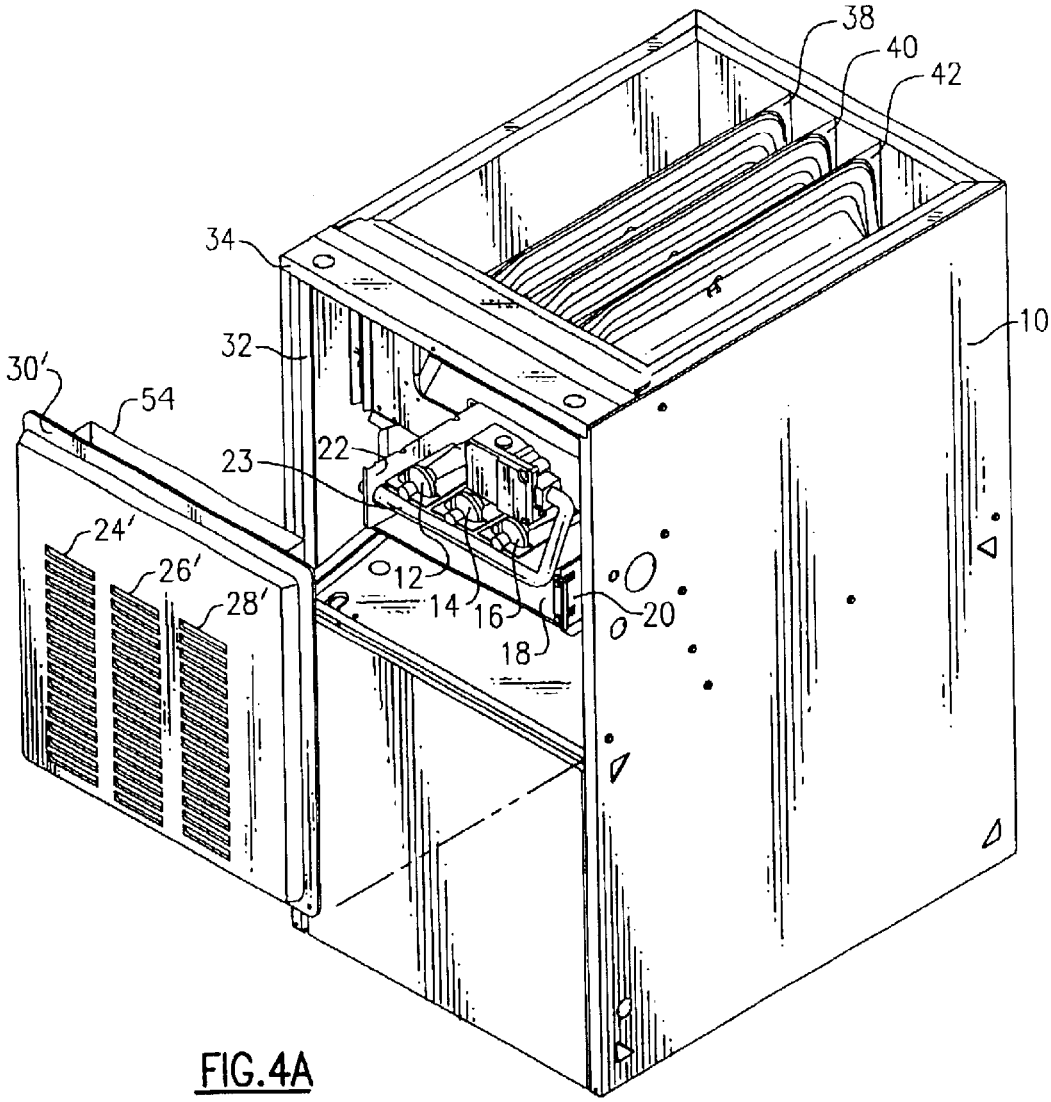
FIG. 4A is a perspective view of a furnace having a differently shaped removable door with a differently shaped sound shield that is moved into place in front of a burner assembly in the furnace.
Figure 4B:
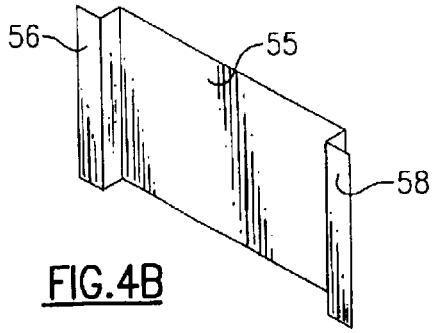
FIG. 4B is a view of the sound shield of FIG. 4A.

Referring now to FIG. 4A, a differently shaped door 30' having slotted vents 24', 26' and 28' is to be attached to the furnace 10 in much the same way as previously described for the door 30 of FIG. 1. The front of the door 30' is seen to be flat as opposed to being curved. The sound shield 54 associated with the door 30' extends rearward of the back edges of the door so as to extend into the furnace 10 in the vicinity of the burners. The shape of the sound shield 54 is better shown in FIG. 4B. In particular, the sound shield is seen to consist of an indented portion 55 and associated side portions that are further bent to form flat end portions 56 and 58. These flat end portions preferably attach to the inwardly turned back edges of the door 30' in much the same manner as has been previously described for shield 48. It is to be appreciated that the depth of the sound shield or the amount by which it extends into the furnace 10 will depend on the particular air flow demands of the burners 12, 14, and 16. In this regard, the spacing from the slotted vents in the door 30' as well as the spacing of the back side of the sound shield from the burners will need to be defined such that adequate air flow occurs while still creating the necessary barrier to the noise waves from the burners. It is finally to be appreciated that the shield 54 of FIG. 4B could be used with the door 30 of FIG. 1 and the shield 48 of FIGS. 2, 3A and 3B could be used with the door 30' as long as there are appropriate spacings of these shields from the back of the door and the front of the burner assembly. It is furthermore to be appreciated that a flat door with slotted vents could also be used with the sound shield 48 as long as there is appropriate spacing of the indented portion 55 of the sound shield from the back of such a door and the front of the burner assembly.

Figure 5:
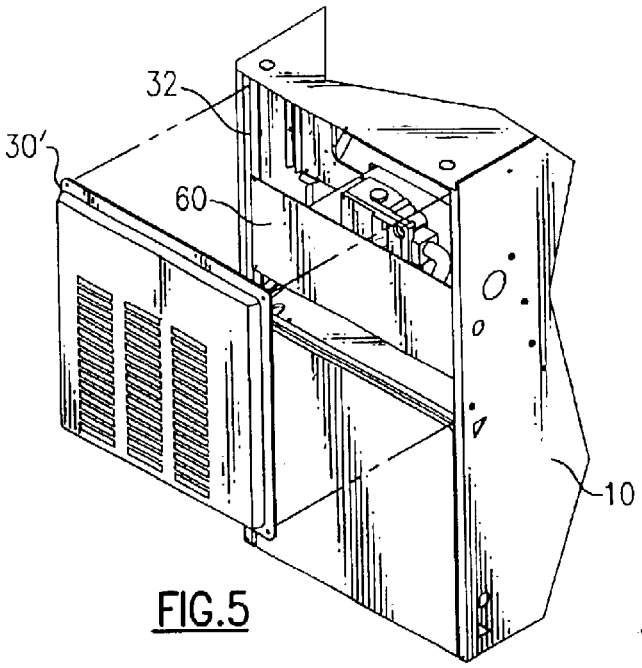
FIG. 5 is a view of a furnace with removable door wherein the sound shield is attached to the body of the furnace.

Referring now to FIG. 5, a sound shield 60 spans the burner assembly and is attached to the vertical members such as 32 of the furnace 10. The sound shield 60 is in this instance flat as is the sound shield 48 of FIG. 1. The sound shield 60 is however removable from the vertical members of the furnace whereas the sound shield 48 is fixedly attached to the door 30. The manner in which the sound shield 60 is attached can vary and can include some sort of a slotted engagement with the vertical members or attachment by low profile fasteners so as to not unduly interfere with the fit of the door 30' with the furnace 10. It is finally to be noted that the door 30' is in this instance fastened at both the top and bottom to the vertical members as opposed to sliding up under a piece such as 34 in FIG. 1. It is also to be appreciated that the door 30 of FIG. 1 could be fastened to the vertical members of the furnace of FIG. 1 in the event that the top piece 34 were not present in FIG. 1. It is finally to be appreciated that the spacing of the sound shield 60 and the extent to which it covers the burner assembly will need to be addressed for a particular application.

Figure 6:
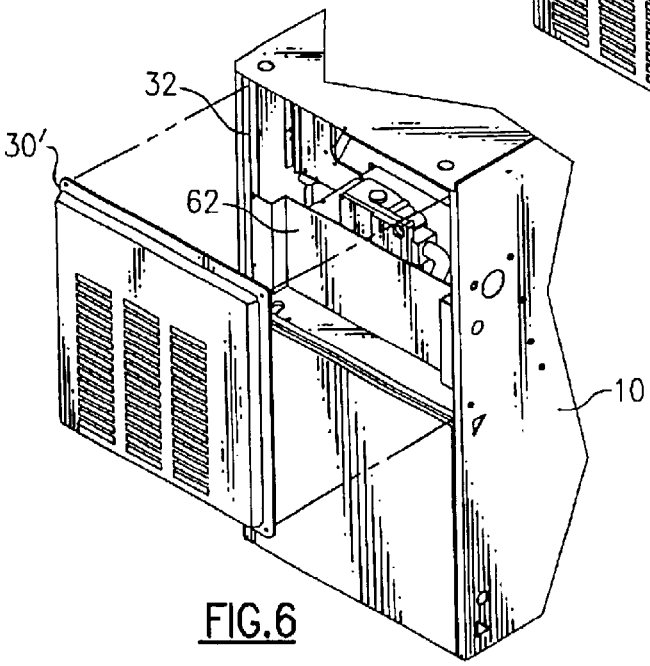
FIG. 6 is a view of a furnace with removable door wherein the sound shield extends into the interior of the furnace.

Referring now to FIG. 6, a formed sound shield 62 spans the burner assembly and is attached to the vertical members such as 32 of the furnace 10. In this case, the sound shield is formed in such a manner as to extend inwardly from the front of the furnace body toward the burner assembly. The manner in which the sound shield 62 is attached to the vertical members can vary in much the same manner as has been previously described for the sound shield 60. The shape of the sound shield 62 is seen to be similar to the shape of the sound shield 54 of FIGS. 4A and 4B. The thus shaped sound shield 62 extends into the interior of the furnace 10. The spacing of the sound shield 62 from the burner assembly becomes the most important consideration since there is now ample spacing from the vents of the door. The degree of this spacing is in this case dependent on the particular air flow needs of the burners.

Figure 7:
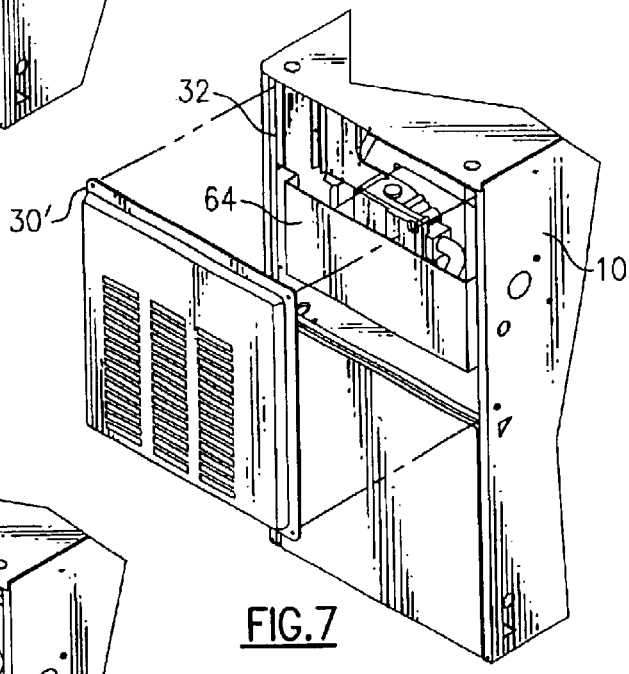
FIG. 7 is a view of a furnace wherein the sound shield is attached to the body of the furnace but extends into the interior of the removable door.

Referring now to FIG. 7, a formed sound shield 64 spans the burner assembly and is attached to the vertical members such as 32 of the furnace 10. In this case, the sound shield is formed in such a manner as to extend outwardly from the front of the furnace body and into the interior of door 30'. The manner in which the sound shield 64 is attached to the vertical members can vary in much the same manner that has been previously described for the sound shield 60. The formed sound shield 64 is however the reverse of the sound shield 54 of FIGS. 4A and 4B. In this regard, the sound shield 62 extends into the interior of the door 30' instead of into the interior of the furnace 10. The spacing of the sound shield 64 from the vents in the door 30' becomes the most important consideration since there is now ample spacing from the burner assembly. The degree of this spacing is again dependent on the amount and size of uncovered vents as well as the particular air flow demand of the burners.

Figure 8:
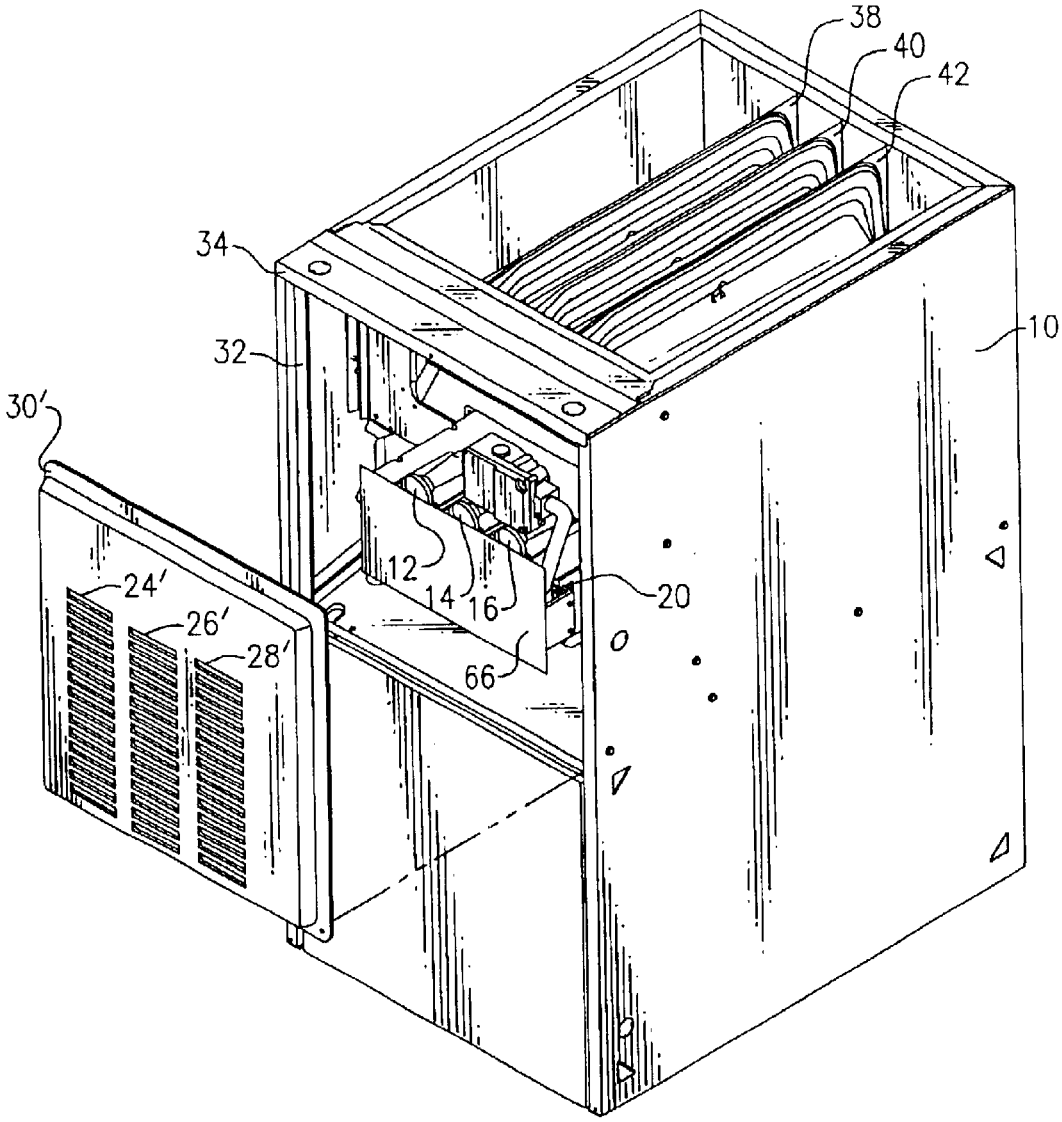
FIG. 8 is a view of a furnace with removable door wherein the sound shield is attached directly to the burner assembly.

Referring now to FIG. 8, a sound shield 66 spans the burner assembly and is removably attached to the side members such as 20 of the burner chamber. In this case, the sound shield is not attached to the furnace body or the door.

The manner in which the sound shield 66 is attached to the side members of the burner chamber can vary as long as the sound shield can be easily removed for servicing of the burners. The spacing of the sound shield 66 from the burner assembly becomes the most important consideration since there is now ample spacing from the vents of the door. The degree of this spacing is in this case dependent on the particular air flow needs of the burners behind the sound shield.

It is to be appreciated that a number of embodiments of a sound shield positioned between the burners of a furnace and the front enclosure portion of the furnace have been disclosed herein. It will be appreciated by those skilled in the art that further changes could be made to the above-described embodiments of the positioned sound shield without departing from the scope of the invention. Accordingly, the foregoing description of various embodiments of the positioned sound shield is by way of example only and the invention is to be limited only by the following claims and equivalents thereto.

What is claimed is:

1. A furnace having a body comprising:

a burner assembly disposed within a burner chamber with the furnace body and having at least one burner producing at least one flame that provides heat to at least one heat exchanger disposed within the furnace body downstream of the burner assembly;

a cover piece that attaches to a front portion of the furnace body, said cover piece having vents therein which allow for air to be drawn into the burner assembly; and a sound shield positioned in front of the burner assembly between said cover piece and the burner assembly so as to interfere with the propagation of noise from the burner assembly when producing the at least one flame that provides heat to said at least one heat exchanger.

2. The furnace of claim 1 wherein the sound shield is attached to the cover piece.

3. The furnace of claim 2 wherein the sound shield is positioned relative to the vents in the cover piece so as to redirect the flow of air from only a portion of the vents in the cover piece to the burner assembly.

4. The furnace of claim 3 wherein the sound shield is a flat piece of sheet metal attached to the back of the cover piece.

5. The furnace of claim 3 wherein the sound shield includes an indented portion which extends into the portion of the furnace wherein the burner assembly is located.

6. The furnace of claim 3 wherein said sound shield includes an indented portion which extends into the interior of said cover piece.

7. The furnace of claim 2 wherein the cover piece is removable from the body of the furnace and whereby the sound shield is fixedly attached to the cover piece so as to remain attached to the cover piece when the cover piece is removed from the furnace body.

8. The furnace of claim 1 wherein the sound shield is attached to the furnace body.

9. The furnace of claim 8 wherein the sound shield is positioned relative to the vents in the cover piece so as to redirect the flow of air from only a portion of the vents in the cover piece to the burner assembly.

10. The furnace of claim 8 wherein the sound shield is a flat piece of sheet metal attached to the furnace body.

11. The furnace of claim 8 wherein the sound shield includes an indented portion which extends into the portion of the furnace wherein the burner assembly is located.

12. The furnace of claim 8 wherein said sound shield includes an indented portion which extends into the interior of said cover piece.

13. The furnace of claim 8 wherein the attachment of said sound shield to the body of the furnace allows for the sound shield to be easily detached so as to permit access to the burner assembly.

14. The furnace of claim 1 wherein said sound shield is attached to structure defining the burner chamber in which the burner assembly is located.

15. The furnace of claim 14 wherein the attachment of said sound shield to the structure defining the burner chamber allows for the sound shield to be easily detached so as to permit access to the burner assembly.

* * * * *